US007938192B2

(12) United States Patent
Rytlewski

(10) Patent No.: US 7,938,192 B2
(45) Date of Patent: May 10, 2011

(54) PACKER

(75) Inventor: Gary Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 10 days.

(21) Appl. No.: 12/276,472

(22) Filed: Nov. 24, 2008

(65) Prior Publication Data

US 2010/0126733 A1 May 27, 2010

(51) Int. Cl.
*E21B 33/128* (2006.01)

(52) U.S. Cl. ..... 166/387; 166/118; 166/179

(58) Field of Classification Search ..... 166/387, 166/179, 118, 196
See application file for complete search history.

(56) References Cited

U.S. PATENT DOCUMENTS

| | | | | |
|---|---|---|---|---|
| 1,407,570 | A | 2/1922 | Peirce | |
| 2,174,076 | A | 9/1939 | Bowen | |
| 2,670,797 | A | 3/1954 | Armentrout | |
| 3,529,836 | A * | 9/1970 | Hyde | 277/323 |
| 7,281,588 | B2 | 10/2007 | Shampine | |
| 2006/0124304 | A1 * | 6/2006 | Bloess et al. | 166/285 |
| 2007/0039161 | A1 | 2/2007 | Garcia | |
| 2007/0089886 | A1 | 4/2007 | Orban | |

* cited by examiner

*Primary Examiner* — William P Neuder
(74) *Attorney, Agent, or Firm* — Rodney V. Warfford; Tim Curington

(57) ABSTRACT

A packer that is usable with a well includes an anchor. The anchor includes at least one spirally extending ring, which is adapted to be selectively radially expanded to secure the packer to a casing string.

20 Claims, 4 Drawing Sheets

PACKER

BACKGROUND

The invention generally relates to a packer.

A packer is a device that is used in a well to form an annular seal between an inner tubular member and a surrounding outer tubular member (a casing string or a liner, as just a few examples) or borehole wall. As examples, the inner tubular member may be a tubular string (a test string, production string, work string, etc.) or may be part of a downhole tool (a formation isolation valve, bridge plug, etc.).

One type of conventional packer has a seal element that is formed from a set of elastomer seal rings. The rings are sized to pass through the well when the packer is being run downhole into position. When the packer is in the appropriate downhole position and is to be set, gages of the packer compress the rings to cause the rings to radially expand to form the annular seal.

A weight-set packer uses the weight of the string and possibly the weight of additional collars to compress the packer's seal rings. In this regard, when the packer is to be set, the string may be mechanically manipulated from the surface of the well to initiate the release of the weight on the rings.

A hydraulically-set packer uses fluid pressure to compress the seal rings. The fluid pressure may be pressure that is communicated downhole through a tubing string; annulus pressure; pressure that is communicated downhole through a control line; etc.

Other types of packers may include seal elements that are set without using compression. For example, a packer may have an inflatable bladder that is radially expanded to form an annular seal using fluid that is communicated into the interior space of the bladder through a control line. As another example, a packer may have a swellable material that swells in the presence of a well fluid or other triggering agent to form an annular seal.

SUMMARY

In an embodiment of the invention, a packer that is usable with a well includes an anchor. The anchor includes at least one spirally extending ring, which is adapted to be selectively radially expanded to secure the packer to a casing string.

In another embodiment of the invention, a technique that is usable with a well includes providing at least one spirally extending ring on a packer. The technique includes anchoring the packer to a casing string, which includes radially expanding the spirally extending ring(s).

Advantages and other features of the invention will become apparent from the following drawing, description and claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
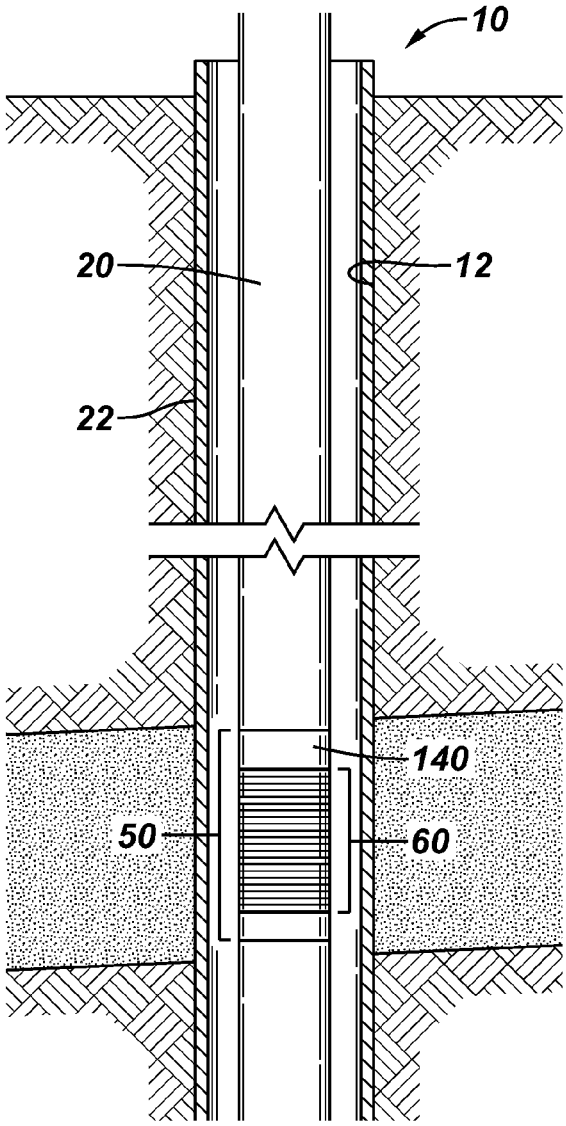
FIG. 1 is a schematic diagram of a well according to an embodiment of the invention.

Referring to FIG. 1, in accordance with embodiments of the invention, a well 10 (a subsea or a subterranean well) includes a wellbore 12, which is lined and supported by a tubular casing string 22. It is noted that although FIG. 1 depicts a vertical wellbore 12, the wellbore 12 may be a lateral or deviated wellbore, in accordance with other embodiments of the invention.

A tubular string 20 (a production tubing string, test string or a work string, as non-limiting examples) extends downhole inside the casing string 22 and contains a packer 50. The packer 50 is depicted in FIG. 1 as being in an unset state. However, the packer 50 may be set for purposes of forming an annular seal between the exterior surface of the string 20 and the interior surface of the casing string 22. In accordance with embodiments of the invention described herein, the packer 50 includes one or more spirally extending rings 60 that are used to anchor the packer 50 to the casing string 22 and possibly form an annular seal for the packer 50. Each ring 60 spirally, or helically, extends along a longitudinal axis of the packer 50 and is radially expanded when the packer 50 is set for purposes of anchoring the packer 50 to the casing string 22.

More specifically, in accordance with some embodiments of the invention, when the packer 50 is in its unset state (often called a "run-in-hole" state), each spirally extending ring 60 surrounds a reduced outer diameter section of a mandrel of the packer 50, an arrangement that aids running the string 20 downhole, as the outer diameter(s) of the ring(s) 60 are kept sufficiently small to pass unimpeded through the casing string 22. The packer 50 includes at least one collar, or sleeve, such as sleeve 140, which, when the packer 50 is set, is activated to move the spirally extending ring(s) 60 to an increased outer diameter section of the packer 50 (as further described below) to radially expand the ring(s) 60. When expanded, each spirally extending ring 60 "bites" into the interior surface of the casing string 22 for purposes of anchoring the packer 50 to the string 22.

As depicted in FIG. 1, in accordance with some embodiments of the invention, the packer 50 includes a single sleeve 140 that may be actuated for purposes of moving the spirally extending ring(s) 60 to an increased outer diameter segment of the packer 50 to radially expand the ring(s) 60 and set the packer 50. However, it is noted that other embodiments are contemplated and are within the scope of the appended claims. For example, in accordance with other embodiments of the invention, the packer 50 may have multiple sleeves that are actuated for purposes of radially expanding spirally extending rings 60, which may be located between pair(s) of the sleeves, for example.

Figure 2:
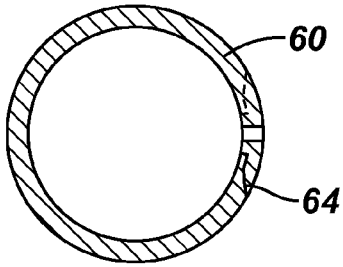
FIG. 2 is a top view of a spirally extending ring according to an embodiment of the invention.
Figure 3:
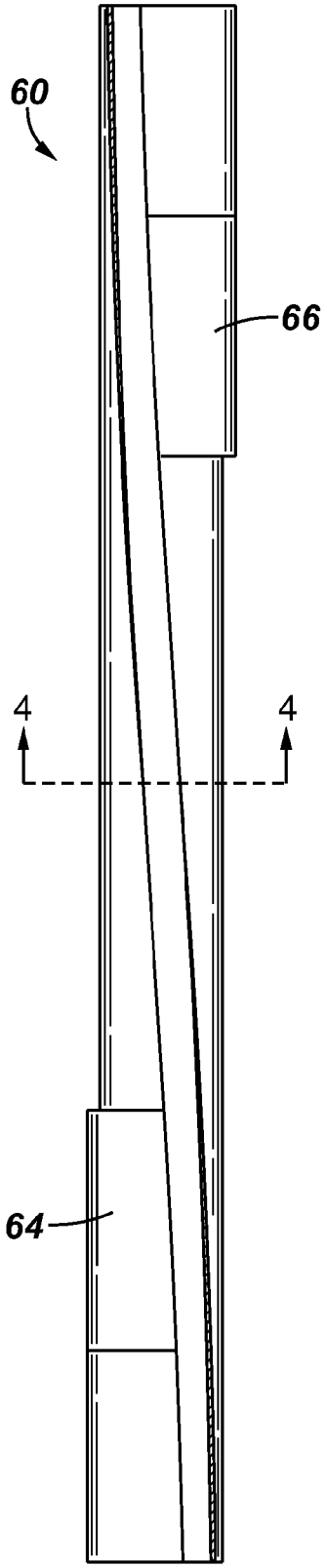
FIG. 3 is a side view of the spirally extending ring of FIG. 2 according to an embodiment of the invention.

Referring to FIGS. 2 and 3, as an example, in accordance with some embodiments of the invention, the spirally extending ring 60 may be formed from a resilient, or "spring-like" core material (a metal, for example) that follows a right circular cylinder-based helical path. Thus, in general, the spirally extending ring 60 includes a first end 64 that spirally extends around the longitudinal axis of the packer 50 to a second end 64 of the ring 60. As an example, in accordance with some embodiments of the invention, the spirally extending ring 60 may be similar in design to a spirally extending retainer ring. The spirally extending ring 60 may be formed from a single material, such as metal, in accordance with some embodiments of the invention. However, in accordance with other embodiments of the invention, the spirally extending ring 60 may also include a material that functions as a sealing element to form an annular seal between the packer 50 and the interior surface of the casing string 22 when the packer 50 is set.

Figure 4:
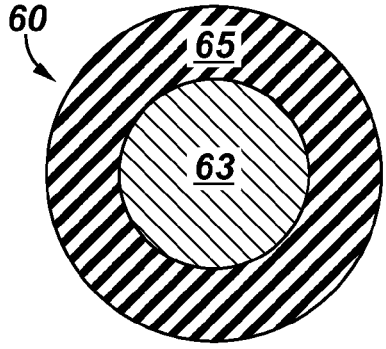
FIG. 4 is a cross-sectional view of the spirally extending ring taken along line 4-4 of FIG. 3 according to an embodiment of the invention.

Referring to FIG. 4, as a more specific example, in accordance with some embodiments of the invention, the spirally extending ring 60 may include a metal core 63, and a rubber sealing element may be bonded to the metal core 63 in the form of an outer coating 65 (a rubber or elastomeric material coating, for example). The spirally extending ring 60 is, in general, longitudinally compressed for purposes of radially expanding the ring 60, and due to this compression, the outer coating 65 is also compressed, which causes the coatings 65 on adjacent rings 60 to squeeze together to radially expand and form the annular seal for the packer 50.

In other embodiments of the invention, a sealing element for the packer may be formed from a material (a rubber or elastomeric material, for example) that is adjacent to but not bonded to a spirally extending ring 60, as further described below.

It is noted that in addition to anchoring the packer 50 to the casing string 22, the spirally extending ring(s) 60 may serve as anti-extrusion, or backup, ring(s) for the packer's sealing element(s).

For embodiments of the invention in which the spirally extending ring 60 is formed solely from a metal material, the metal material serves two functions: the metal both bites into the interior surface of the casing string 22 and forms a metal-to-metal annular seal in the well. Such a spirally extending ring may be optimized for use in relatively high temperature applications (well environments over 500° F., for example) where it may be challenging to form an annular seal using a seal element that is formed from a rubber or elastomeric material. As a more specific and non-limiting example, a metal-to-metal seal formed from a packer in accordance with embodiments of the invention may be particularly useful in a steam injection well.

For the embodiments described below, it is assumed that the packer 50 includes multiple spirally extending rings 60, although the packer may include a single spirally extending ring, in accordance with other embodiments of the invention.

Figure 5:
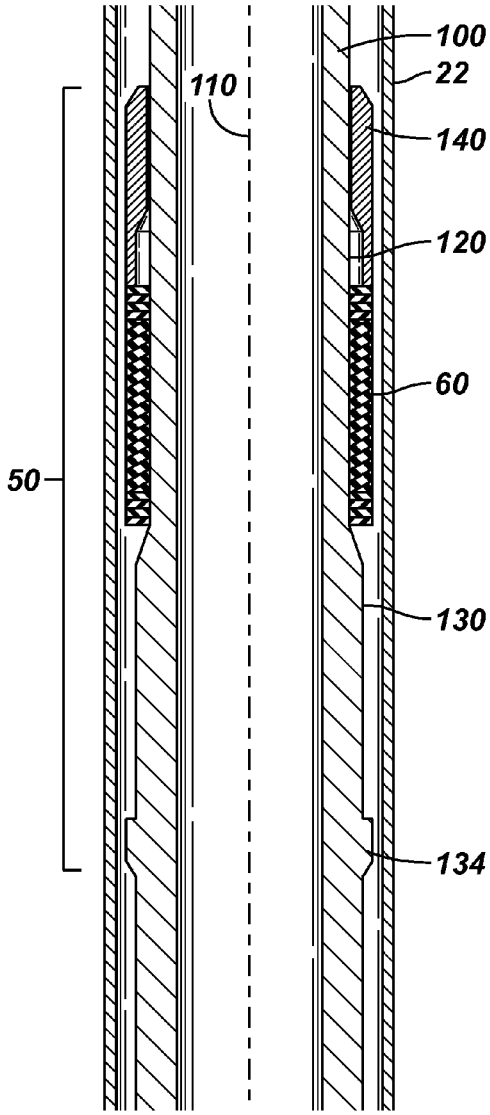
FIG. 5 is a schematic diagram of a packer in an unset state according to an embodiment of the invention.

FIG. 5 generally depicts a schematic diagram of the packer 50 in an unset set in accordance with some embodiments of the invention. For these embodiments of the invention, the spirally extending ring 60 performs two functions: the ring 60 anchors the packer 50 to the casing string 22, and the ring 60 forms an annular seal in the well. For example, an elastomeric or rubber material may be bonded or otherwise affixed to the spirally extending ring(s) 60. Alternatively, in other embodiments of the invention, the spirally extending ring 60 is formed from a metal that serves both functions.

In general, the spirally extending sealing rings 60 circumscribe an internal mandrel 100 of the packer 50. In general, the mandrel 100 has a central passageway that forms a corresponding segment of the central passageway of the string 20 (see also FIG. 1). The outer surface of the mandrel 100 is radially tapered along a longitudinal axis 110 of the packer 50 for purposes of facilitating the radial expansion and contraction of the spirally extending rings 60.

Figure 6:
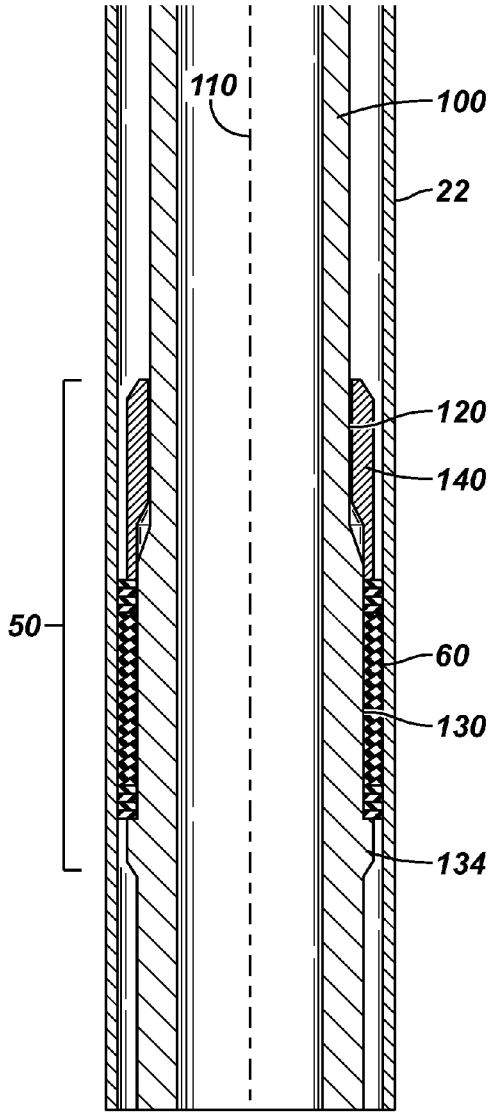
FIG. 6 is a schematic diagram of the packer of FIG. 5 in a set state according to an embodiment of the invention.

More specifically, in accordance with some embodiments of the invention, the outer surface of the mandrel 100 has a first segment 120, which has a reduced outer diameter for purposes of maintaining the spirally extending rings 60 in an unexpanded state for the unset state (i.e., the run-in-hole state) of the packer 50. Thus, the spring-like tension of the spirally extending rings 60 keeps the rings on the segment 120 for the unset state of the packer 50. As depicted in FIG. 5, when the packer 50 is unset, the spirally extending rings 60 extend around the first segment 120 of the mandrel 100. Referring to FIG. 6, when the packer 50 is set, the gage 140 moves downwardly (due to the downward force that is applied by an actuator (not shown), to push the spirally extending rings 60 onto a second segment 130 of the mandrel 100, which has a relatively larger outer diameter. As depicted in FIG. 6, when pushed onto the larger diameter segment 130, the inner diameters of the spirally extending rings 60 expand to therefore radially expand the outer diameter of rings 60 for purposes of causing the rings 60 to engage the interior surface of the casing string 22 to anchor the packer 50 to the string 22. A lower shoulder 134 on the mandrel 100 may be used to limit the downward travel of the spirally extending rings 60, in accordance with some embodiments of the invention.

Figure 7:
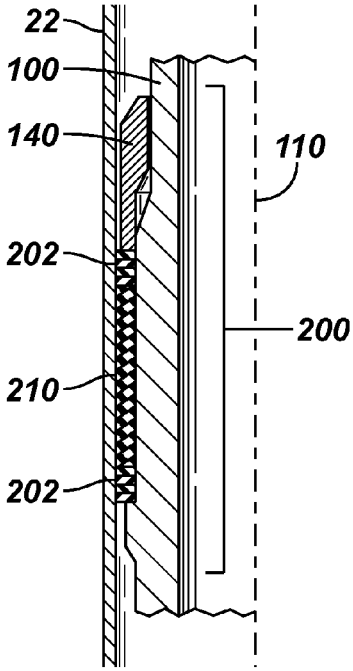
FIGS. 7, 8 and 9 are partial schematic diagrams of packers according to alternative embodiments of the invention.

In accordance with other embodiments of the invention, the sealing element(s) of the packer may be separate from the spirally extending rings 60, such as, by way of example, in a packer 200 that is depicted in FIG. 7. It is noted that FIG. 7 depicts a left hand cross-section of the packer 200, with it being understood that the packer 200 includes a right hand portion that generally minors the left hand portion depicted in FIG. 7 about a longitudinal axis 110 of the packer 200. Additionally, the same reference numerals have been used in FIG. 7 to denote similar elements that are described above.

In general, the packer 200 includes a sealing element 210 that is separate from spirally extending rings 202 of the packer 200. As non-limiting examples, the seal element 210 may be an elastomeric or rubber ring that surrounds the longitudinal axis 110. As shown, for this example, the spirally extending rings 202 are located longitudinally above and below the sealing element 210. When the sleeve 140 moves downwardly, the spirally extending rings 202 radially expand to anchor the packer 200 to the casing string 22 (due to the rings 202 being moved over a larger diameter surface), and the sealing element 210 radially expands (due to its compression) to form an annular seal in the well. It is noted that the mandrel 100 may have a radially varying outer surface, similar to the one discussed above in connection with FIGS. 5 and 6.

Figure 8:
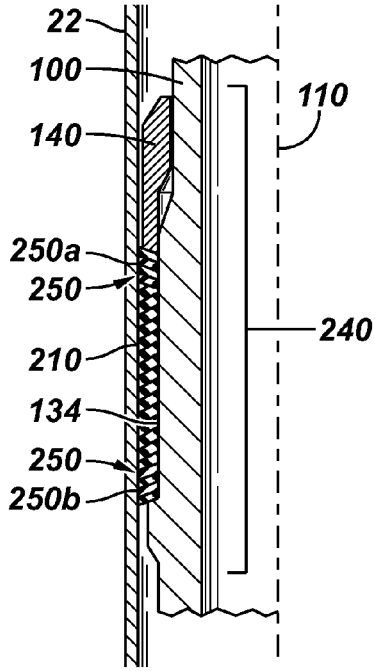

As another variation, FIG. 8 depicts a packer 240 in accordance with other embodiments of the invention. FIG. 8 depicts a left hand cross-section of the packer 240, with it being understood that the packer 240 is generally symmetrical about the longitudinal axis 110 and thus, includes a mirroring right hand section, which is not shown in FIG. 8. Additionally, the same reference numerals have been used in FIG. 8 to refer to similar components that are described above.

Unlike the packer 200 (FIG. 7), the packer 240 includes spirally extending rings 250 (replacing the spirally extending rings 202 of the packer 200), which are substantially slanted, relative to the longitudinal axis 100. The spirally extending rings 250 are arranged in two sets: an upwardly facing set 250*a* above the sealing element 210 and a downwardly facing set 250*b* below the sealing element 210. The slanted design of the spirally extending ring 250 allows the sequentially setting of the two sets 250*a* and 250*b* of spirally extending rings: the lower set 250*b* of rings is set first, which is followed by the compression and setting of the seal element 110 and the setting of the upper set of rings 250. This design avoids a possible challenge that may occur if the spirally extending rings are all flat: the upper set of rings may set first, which may prevent the full expansion of the sealing element and the setting of the lower set of rings.

Figure 9:
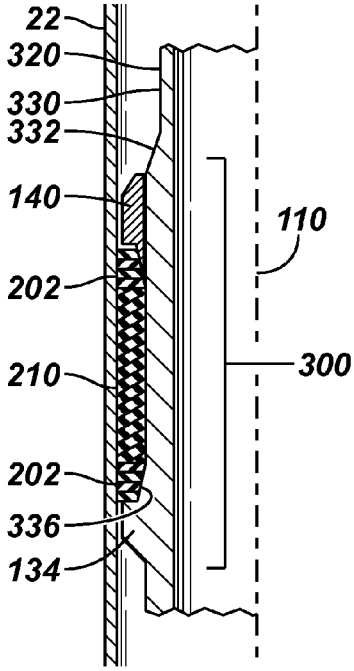

FIG. 9 depicts a packer 300 in accordance with yet another embodiment of the invention. Similar to FIGS. 7 and 8, FIG. 9 depicts a left hand cross section of the packer 300, with it being understood that the packer 300 is generally symmetrical about the longitudinal axis 110; and thus, the packer 300 contains a mirroring right hand cross-section that is not depicted in FIG. 9. Furthermore, like reference numerals are used to denote similar components, which are described above.

The packer 300 has a similar design to the packer 200 (see FIG. 7), except for the outer surface profile of a mandrel 320 (that replaces the mandrel 100 of FIG. 7, for example). In particular, the outer surface of the mandrel 320 has three general longitudinal segments: a top segment 330, which has a reduced diameter for purposes of keeping the spirally extending rings 202 in their unexpanded states during the unset state of the packer 300; a middle segment 332 of increasing diameter for purposes of receiving the lower end of the mandrel 140, radially expanding an upper set of the spirally extending rings 202 and accommodating the seal element 210; and a lower segment 336, that has an increasing outer diameter for purposes of radially expanding a lower set of the spirally extending rings 202.

Many different actuating mechanisms may be used to set the packer (i.e., to move the sleeve(s) of the packer). As non-limiting examples, the packer may have an actuator that configures the packer to be a weight-set packer, mechanically-set packer, hydraulically-set packer, electrically-set packer, etc. Numerous systems/techniques may be used to communicate mechanical, wired or wireless stimuli downhole to set the packer and possibly release the packer, in accordance with the many different potential embodiments of the invention.

The packers that are described herein may be used in a variety of different applications. For example, in some embodiments of the invention, the packer may be used as the main packer to establish a primary seal in a well. In other embodiments of the invention, a conventional main packer may be used to establish the primary seal in a multiple zone well, and one or more packers that contain spirally extending rings may be used for purposes of establishing zonal isolation. As mentioned above, the packer, in accordance with some embodiments of the invention, may be used in a high temperature application to form a metal-to-metal annular seal in the well.

It is noted that the context of this application, "a packer" generally refers to any downhole tool that may be actuated to establish an annular seal in a well. Thus a "packer" in the context of this application includes tools that are not traditionally labeled as "packers," such as a bridge plug, a formation isolation valve, etc.

The packer that is described herein may have one or more of the following advantages. The packer may be relatively less complex and less expensive than a conventional packer. The packer may be used to form a metal-to-metal annular seal in a well, which may be particularly advantageous in a high temperature application. The spirally extending rings diminish the need for "gage rings," which allows the diameter of the packer to be relatively smaller when running in the hole. A smaller diameter for the packer, in turn, may allow for a faster trip time and/or a higher pump rate prior to the setting of the packer. Other and/or different advantages are possible in accordance with other embodiments of the invention.

Other embodiments are within the scope of the appended claims. For example, a sealing element for the packer may be formed from a material other than an elastomeric, rubber or metal material, in accordance with other embodiments of the invention. The sealing element may not be a compression set-type ring in accordance with some embodiments of the invention. For example, a sealing element for the packer may be a bladder-type element, a swellable material, etc., in accordance with other embodiments of the invention.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A packer usable with a well, comprising:

a mandrel comprising a radially tapered outer surface;

an anchor comprising at least one spirally extending ring; and a sleeve adapted to selectively move relative to the mandrel to move said at least one spirally extending ring along the radially tapered outer surface to radially expand said at least one spirally extending ring to secure the packer to a casing string.

2. The packer of claim 1, wherein said at least one spirally extending ring extends about a longitudinal axis of the packer.

3. The packer of claim 1, further comprising:

a sealing element to form an annular seal in the well.

4. The packer of claim 3, wherein the sealing element is bonded to said at least one spirally extending ring.

5. The packer of claim 3, wherein the sealing element is separate from said at least one spirally extending ring.

6. The packer of claim 3, wherein the sealing element at least partially circumscribes the mandrel, and said at least one spirally extending ring circumscribes the mandrel.

7. The packer of claim 6, wherein the sleeve is adapted to compress the sealing element to radially expand the element.

8. The packer of claim 6, wherein the sleeve is adapted to move said at least one spirally extending ring along the radially tapered outer surface to radially expand said at least one spirally extending ring.

9. The packer of claim 3, wherein the said at least one spirally extending ring is adapted to prevent extrusion of the sealing element.

10. The packer of claim 3, wherein said at least one spirally extending ring comprises a first spirally extending ring and a second spirally extending ring and the sealing element separates the first spirally extending ring from the second spirally extended ring.

11. The packer of claim 1, wherein said at least one spirally extending ring comprises a metal adapted to form a metal-to-metal annular seal in the well.

12. A method usable with a well, comprising:

providing a packer having a mandrel comprising a radially tapered outer surface and at least one spirally extending ring; and anchoring the packer to a casing string, comprising moving a sleeve relative to the mandrel to cause said at least one spirally extending ring to move along the radially tapered outer surface and radially expand.

13. The method of claim 12, wherein the act of anchoring comprises moving said at least one spirally extending ring over a larger diameter surface.

14. The method of claim 12, further comprising:

radially expanding a seal element of the packer to form an annular seal in the well.

15. The method of claim 14, wherein the seal element is bonded to said at least one spirally extending ring.

16. The method of claim 14, wherein the seal element is separate from said at least one spirally extended ring.

17. The method of claim 14, wherein the acts of radially expanding the seal element and anchoring the packer occur concurrently.

18. The method of claim 12, wherein the act of anchoring comprises:

moving said at least one spirally extending ring from a first smaller outer diameter region of the mandrel to a second larger outer diameter region of the mandrel.

19. The method of claim 12, wherein the act of providing comprises providing a first spirally extending ring, a second spirally extending ring and a sealing element, wherein the sealing element separates the first spirally extending ring from the second spirally extending ring.

20. The method of claim 12, wherein the act of anchoring further comprises:

radially expanding said at least one spirally extended ring to form a metal-to-metal annular seal in the well.

* * * * *